US005422665A

United States Patent [19]

Stephany et al.

[11] Patent Number: 5,422,665

[45] Date of Patent: Jun. 6, 1995

[54] LOW-INTERFERENCE THERMISTOR FOR A THERMAL INK JET PRINTHEAD CHIP

[75] Inventors: Joseph F. Stephany, Williamson; Richard V. LaDonna, Fairport; Gary A. Kneezel; Michael Poleshuk, both of Webster; Thomas A. Tellier, Williamson; Thomas E. Watrobski, Penfield; Joseph J. Wysocki, Webster, all of N.Y.

[73] Assignee: Xerox Corporation, Stamford, Conn.

[21] Appl. No.: 68,029

[22] Filed: May 28, 1993

[51] Int. Cl.[6] ..... B41J 2/05

[52] U.S. Cl. ..... 347/19; 347/17

[58] Field of Search ..... 347/17, 14, 56, 19; 338/22 R, 22 SD

[56] References Cited

U.S. PATENT DOCUMENTS 4,910,528 3/1990 Firl et al. ..... 347/17

5,036,337 7/1991 Rezanka ..... 346/1.1

5,073,690 12/1991 Kneezel ..... 347/56

5,175,565 12/1992 Ishinaga et al. ..... 347/17

FOREIGN PATENT DOCUMENTS 505154 9/1992 European Pat. Off. .

3414947 10/1984 Germany ..... 347/17

*Primary Examiner*—Benjamin R. Fuller

*Assistant Examiner*—N. Le

*Attorney, Agent, or Firm*—R. Hutter

[57] ABSTRACT

A thermal ink-jet printhead comprises a substrate having a plurality of heating elements defined thereon. A thermistor, disposed on the substrate, includes a conductor loop which does not encompass the heating elements on the substrate. The configuration of the thermistor significantly reduces both electromagnetic and capacitance interference caused by the heating elements.

4 Claims, 3 Drawing Sheets

LOW-INTERFERENCE THERMISTOR FOR A THERMAL INK JET PRINTHEAD CHIP

The present invention relates to a control system for a thermal ink jet printer. Specifically, the present invention relates to a low-interference thermistor for an ink-jet printhead, provided directly on a silicon chip forming the printhead.

In thermal ink jet printing, droplets of ink are selectively emitted from a plurality of drop ejectors in a printhead, in accordance with digital instructions, to create a desired image on a surface. The printhead typically comprises a linear array of ejectors for conveying the ink to the sheet. The printhead may move back and forth relative to a surface, for example to print characters, or the linear array may extend across the entire width of a sheet (e.g. a sheet of plain paper) moving relative to the printhead. The ejectors typically comprise capillary channels, or other ink passageways, forming nozzles which are connected to one or more common ink supply manifolds. Ink from the manifold is retained within each channel until, in response to an appropriate digital signal, the ink in the channel is rapidly heated and vaporized by a heating element disposed within the channel. This rapid vaporization of the ink creates a bubble which causes a quantity of ink to be ejected through the nozzle to the sheet. An exemplary patent showing the general configuration of a typical ink jet printhead is U.S. Pat. No. 4,774,530.

In many designs of thermal ink jet printing apparatus currently commercially available or contemplated, an essential portion of the printhead, particularly the portion of the printhead having the heating element formed thereon, is in the form of a substrate which may, for example, be made of silicon. This silicon substrate is generally known as the "chip" of the printhead, and typically includes not only the heating elements formed thereon, but the series of electrical leads connecting each of the heating elements to a voltage or current source. The leads are typically in the form of a pattern of aluminum depositions, and the construction of the heating element may be in the form of a deposit of polycrystalline silicon which forms an element having a predetermined resistance.

In a common method of manufacture of thermal ink-jet printhead modules or "chips," each chip is sized to accommodate 128 nozzles spaced at a density of 300 nozzles per inch; on the chip, 128 heating elements are provided, each heating element having at least one lead connected thereto, as well as any other electronic circuitry which may be formed on the chip. In mass production of such chips, as many as 200 or more chips may be formed in a single silicon "wafer," the entire wafer being manufactured and then subsequently cut, or "diced," into the chips themselves.

An important factor affecting the quality of an image formed on a sheet by an ink-jet printhead is uniformity of "spot size." All of the ejectors in a printhead must create spots on the sheet of uniform size given certain operating conditions. The temperature of the liquid ink just before "firing" from the printhead is one key parameter affecting spot size. One example of a system for controlling the spot size by monitoring the temperature of the printhead is described in U.S. Pat. No. 5,036,337, assigned to the assignee of the present application. Because the heating elements create a substantial amount of residual heat in operation, the temperature of the liquid ink in the channels must be measured not only precisely and accurately, but also continuously. There is thus a necessity, in any high-speed or high-quality printing system, to place a precise temperature-monitoring device in close proximity to the liquid ink in the channels, and to update the readings from the device as often as possible.

Because the temperature of liquid ink in the printhead, and by extension the temperature of the printhead, is such an important control input for any high-speed or high-precision thermal ink-jet printing system, it is inevitable that precise and substantially instantaneous monitoring of the printhead temperature is an important design consideration. Expectably, the preferred device for detecting the temperature of the printhead on an ongoing basis is a thermistor disposed on the printhead chip or chips. As is well known, a thermistor is an electrical device which provides a resistance which is dependent on the temperature of the device. Because of the exacting precision and the need for rapid response to even a very small change in temperature, the thermistors disposed on the printhead chip or chips must be in excellent thermal contact with the ink in the region of interest. What is more, it is advantageous to fabricate the thermistor using one of the same materials and sequence of processing steps as is already used to fabricate the thermal ink jet chip, so that the thermistor is provided at no additional cost. For example, a preferred type of thermistor on a thermal ink-jet printhead chip consists of a lightly doped polysilicon resistor which extends across the chip in the vicinity of the heating elements which are used to vaporize the liquid ink. One consideration with this type of sensor is that the change in resistance, and consequently the change in voltage, for a given temperature increment is very small, only on the order of 0.001 parts per degree celsius.

For reliable operation of the thermistor in a practical thermal ink-jet printhead chip, external sources of noise become an extremely important concern. It is desirable that the thermistor be disposed on the chip at a location as close as possible to the channels themselves for a most accurate reading of the actual temperature of the liquid ink just before a given ejector is fired. At the same time, the location of the thermistor must be carefully chosen because another requirement of a practical printhead is that the chip be as small as physically possible, yet still accommodate all the circuits required for effective operation. This extreme compactness of the chip design, particularly in regards to the thermistor, creates a serious problem in that the electrical behavior of other elements on the chip, particularly the heating elements and current busses, will cause electromagnetic and capacitance interference with the thermistor. This electrical noise on the thermistor will result in specious signals being output from the thermistor; what is supposed to be merely a reflection of the temperature of the chip will include noise from other electrical sources, which are not directly relevant to the temperature signal.

FIG. 4 shows a configuration of a thermal ink-jet printhead chip having an array of heating elements 26 and external contact pads 54 disposed on a surface 52 of the chip 50. As can be seen in FIG. 4, the "best" place for placing the thermistor 99 would be in the space between the heating elements and the edge of the chip. Such a location of the thermistor would place the thermistor as close as possible thermally to the liquid ink which is about to be ejected from the printhead. However, if one follows the thermistor 99 and its associated lines and contact pads on the chip itself, it becomes apparent that the thermistor 99 and its leads on the chip form a significant portion of induction loop, with the heating elements 26 disposed within the loop. As the various heating elements 26 are activated while the printhead is in use, it follows that the electric fields created by the heating elements 26 will induce small currents in the thermistor 99, and these induced currents will become a serious and damaging source of noise for the whole temperature-measurement system. There is thus a significant problem for a designer of printhead chips in compromising the precision gained by placing the thermistor close to the liquid ink, and the accuracy lost from unwanted inductive current from heating elements 26.

European Patent Application EP-A2-0 505 154 shows an ink-jet printing system in which the problem of avoiding on-chip interference with the thermistor is avoided by placing the temperature sensor off the chip completely, and then using a computer to calculate an inferred ink temperature based on the off-chip reading and the rate that heat is generated by sampling the data.

According to the present invention, there is provided a thermal ink-jet printhead, comprising a substrate having a plurality of heating elements defined thereon. A thermistor, disposed on the substrate, includes a conductor loop. The heating elements on the substrate are disposed exteriorly of the conductor loop.

While the present invention will hereinafter be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 5:
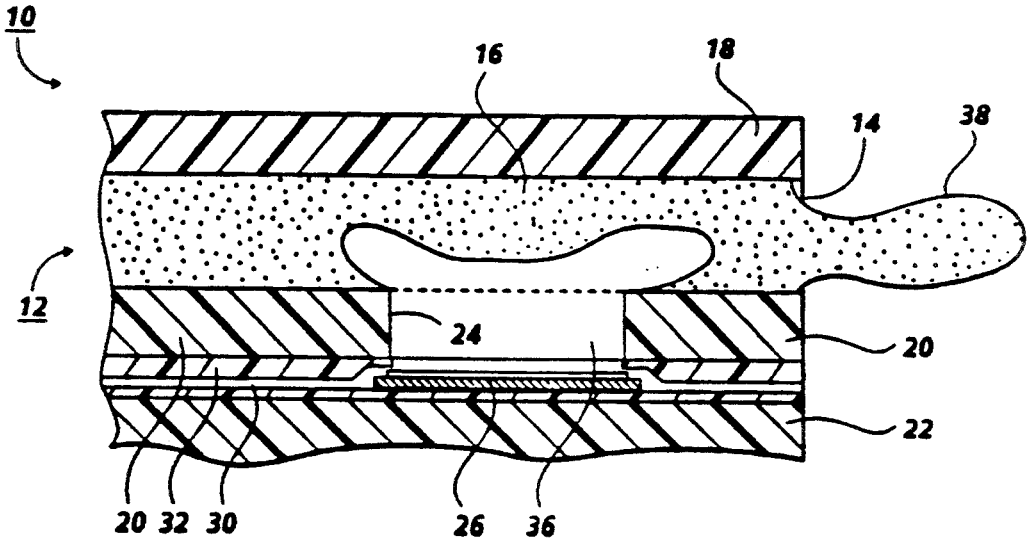
FIG. 5 PRIOR ART
FIG. 5 is a fragmentary sectional elevational view of a drop ejector of an ink jet printhead.

FIG. 5 is a fragmentary sectional elevational view of a drop ejector of an ink jet printhead, one of a large plurality of such ejectors which would be found in one version of an ink jet printhead. Typically, such ejectors are sized and arranged in linear arrays of 300 ejectors or more per inch. As will be used in the detailed description, a silicon member having a plurality of channels for drop ejectors defined therein, typically 128 ejectors, is known as a "die module" or "chip." In currently popular designs, a typical chip defines 128 ejectors, spaced 300 to the inch. In designs with multiple chips, each chip may include its own ink supply manifold, or multiple chips may share a single common ink supply manifold.

Each ejector, or nozzle, generally indicated as 10, includes a capillary channel 12 which terminates in an orifice 14. The channel 12 regularly holds a quantity of ink 16 which is maintained within the capillary channel 12 until such time as a droplet of ink is to be ejected. Each of a plurality of capillary channels 12 are maintained with a supply of ink from an ink supply manifold (not shown). The channel 12 is typically defined by an abutment of several layers. In the ejector shown in FIG. 5, the main portion of channel 12 is defined by a groove anisotropically etched in an upper substrate 18, which is made of a crystalline silicon. The upper substrate 18 abuts a thick-film layer 20, which in turn abuts a lower silicon substrate 22.

Sandwiched between thick film layer 20 and lower substrate 22 are electrical elements which cause the ejection of a droplet of ink from the capillary channel 12. Within a recess 24 formed by an opening in the thick film layer 20 is a heating element 26. The heating element 26 is typically protected by a protective layer made of, for example, a tantalum layer having a thickness of about 0.5 microns. The heating element 26 is electrically connected to an addressing electrode 30. Each of the large number of ejectors 10 in a printhead will have its own heating element 26 and individual addressing electrode 30, to be controlled selectively by control circuitry, as will be explained in detail below. The addressing electrode 30 is typically protected by a passivation layer 32.

When an electrical signal is applied to the addressing electrode 30, energizing the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of a surface on which the mark is to be made by the droplet, and may be, for example, a sheet of paper or a transparency.

Figure 1:
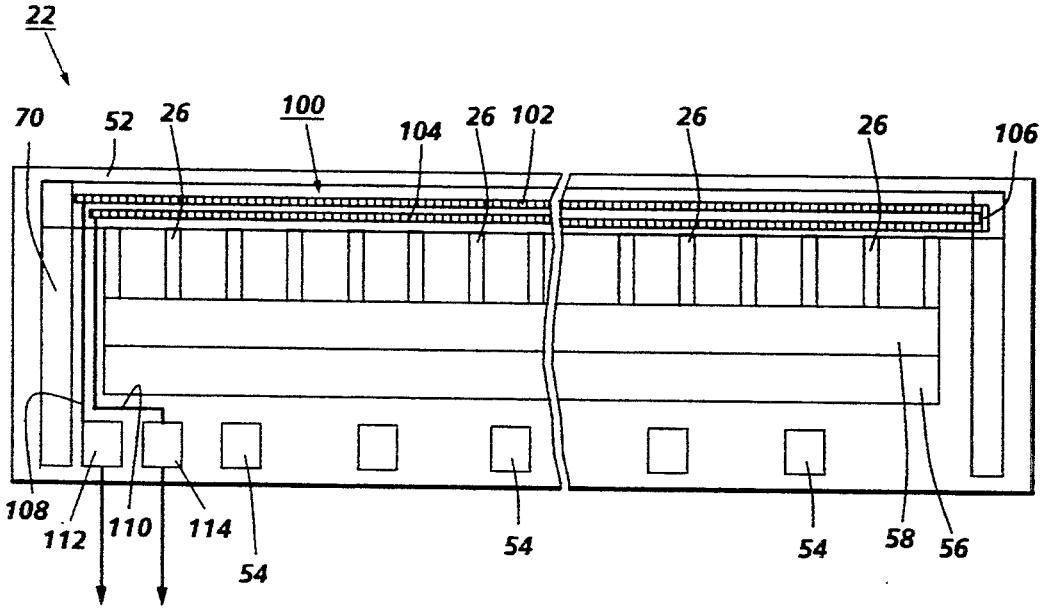
FIG. 1 is a plan view showing a substrate associated with an ink-jet printhead in isolation, showing one embodiment of the present invention.
Figure 4:
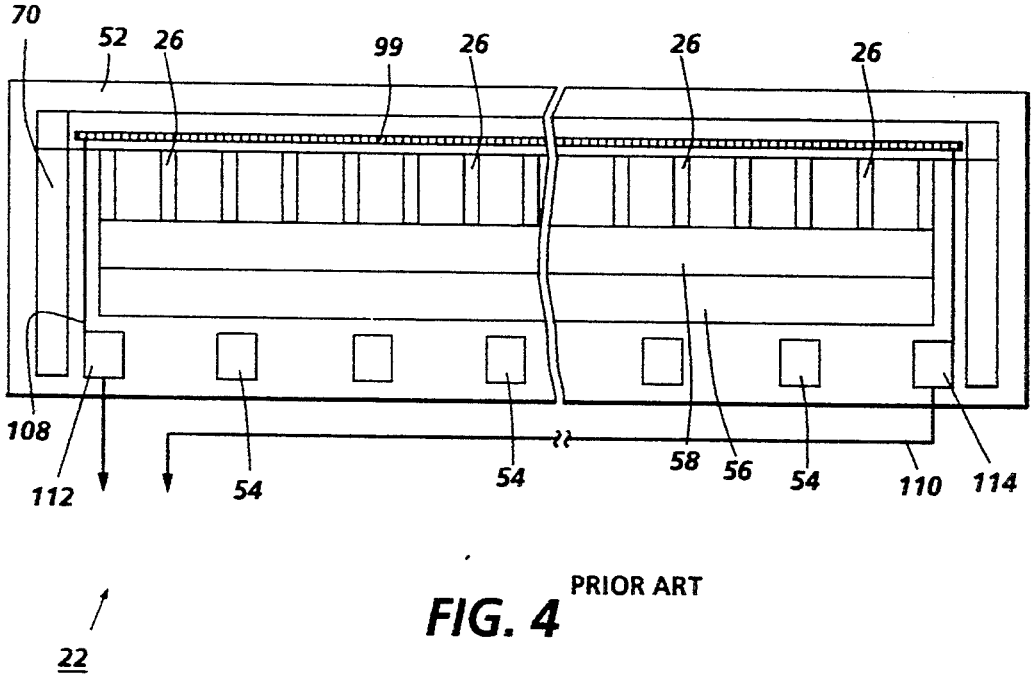
FIG. 4 PRIOR ART
FIG. 4 is a plan view showing a substrate associated with a prior-art ink-jet printhead in isolation.

FIG. 1 is a plan view showing, in isolation, a chip forming the lower substrate 22 of a thermal ink-jet printhead. The main portion of the substrate 22 is typically made of silicon, while the upper surface 52 thereof is a coating of silicon dioxide. Disposed on surface 52 is, for example, a series of terminals 54, by which the printhead is electronically controlled by a printing apparatus. Arrangements of terminals 54 for operation of the printhead are well known in the art, such as, for example, applying digital information in series or in parallel to any number of leads 54 to address a subset of the heating elements 26 on the chip as needed to create a desired image. The specific circuitry for controlling heating elements 26 through terminals 54 is shown generally as logic 56, which may be of any form familiar to those skilled in the art. Logic 56, in turn, drives a set of parallel drivers generally indicated as 58, which serve to activate, that is apply the necessary voltage, to the heating elements 26 as needed. Both logic 56 and drivers 58 may be formed on the surface 52 of substrate 22 using any known IC fabrication techniques.

The set of heating elements 26 in the complete ink-jet printhead would be disposed adjacent corresponding capillary channels in an abutting upper substrate (not shown) to form the ejectors or nozzles of the ink-jet printhead. The heating elements 26 are typically made of polycrystalline silicon connected to depositions of aluminum which also form leads to the respective heating elements 26. The size of the heating elements 26 on the chip shown in FIG. 1 is significantly exaggerated; on a typical practical printhead, there will be on the on the order of 128 heating elements 26 arranged in a linear array approximately 1 centimeter in length. The terminals 54 are made of depositions of aluminum, as is familiar in the art of IC fabrication.

Also visible in the plan view of FIG. 1 is the thermistor of the present invention, generally indicated as 100. The thermistor 100 is preferably made of a lightly doped polysilicon deposit disposed beneath but isolated from the current bus 70. The deposit forming thermistor 100 defines two elongated regions in the form of main lengths 102 and 104, joined by a hair-pin turn 106, which is a very short length of deposition relative to the main lengths. The two main lengths 102 and 104 and hairpin turn 106 form a partial loop on the chip which, significantly, does not encompass any of the heating elements 26. As can be seen, both main lengths 102 and 104 extend parallel to each other, and are comparably as close to each other as one length 104 is to the heating elements 26. The leads to the thermistor 100, shown as 108 and 110, lead respectively to contact pads 112 and 114, from which they are connected to external control circuitry.

The configuration of thermistor 100, with its main lengths 102 and 104 and hair-pin turn 106, act to minimize the creation of noise from external interference in a number of ways. Noise created by induction from the on-and-off behavior of the heating elements 26 near the thermistor 100 is minimized first by minimizing an important physical factor in the creation of induction, that is, the effective area of an induction loop. Because the two main lengths 102 and 104 are disposed very close to each other, there is very little area in the effective loop from which induction current can be created. Further, the fact that the two main lengths 102 and 104 cause current moving through the thermistor 100 to in effect move in opposite directions through the main length, creates a well-known cancellation effect for electric fields near the thermistor 100. This cancellation effect is familiar in the art of antennas: the magnetic fields from the heater currents induce a voltage into one main length and induce an equal voltage of opposite sign in the other main length, and the two magnetic effects cancel.

Figure 2:
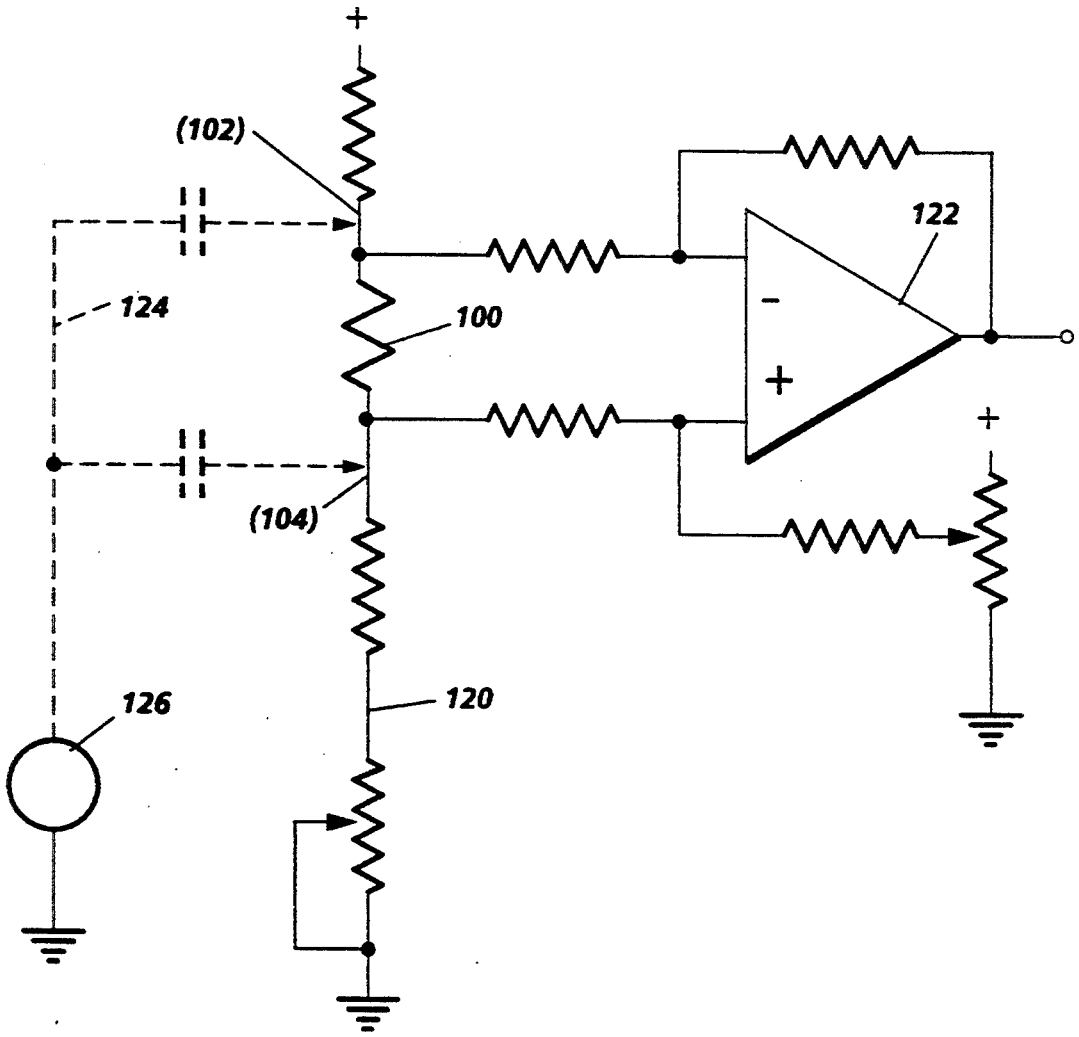
FIG. 2 is a schematic view of circuitry preferably used in conjunction with one embodiment of the present invention.

In addition to electromagnetic interference such as induction, there is also experienced by the thermistor 100 a capacitance interference, because the thermistor 100 and a source of noise on the chip, such as a heating element 26, will in effect form a capacitor between them. The configuration serves to minimize interference noise from parasitic capacitance, by approximately equalizing the capacity coupling of the thermistor to any other noise source, such as a heating element 26, on the chip. FIG. 2 is a schematic diagram showing the behavior of thermistor 100 in conjunction with an operational amplifier, which is typically disposed off the chip, showing how capacitance noise can be canceled out by common-mode rejection. As can be seen in FIG. 2, there is passed through the thermistor 100 a current generated by a reference voltage from the system, shown in FIG. 2 as the vertical line 120 with voltage source and ground. This current and voltage is used as a reference by which changes in voltage caused ,by changes in the resistance of the thermistor 100, which are in turn caused by changes in temperature, can be determined. Also connected to thermistor 100 is an operational amplifier 122 with any number of adjacent resistors, as shown. The operational amplifier 122 amplifies any change in thermistor voltage. It will be noted that the signs of the inputs to the operational amplifier 122 are opposite that of the direction of the reference voltage shown through line 120. Shown schematically in FIG. 2 is a noise source in the form of a heating element 26. When the heating element 26 is activated, the parasitic capacitances, shown in dotted lines as 124 in FIG. 2, will effectively couple in two places along the thermistor 100, namely to both main lengths 102 and 104, the effect of which is shown schematically as two separate parasitic capacitances on either side of the effective thermistor 100. Because the voltage produced by either parasitic capacitance will be of the same polarity to the closest input to operational amplifier 122, there will be a common mode rejection. The inputs of the parasitic capacitances are of the same sign, but are connected to inputs of the operational amplifier that result in opposite signs in the output of the operational amplifier, and nulling of these voltages can be obtained by adjusting the "null noise" potentiometer.

In this way, the hairpin-turn configuration can be used to reduce both the inductive, or magnetic field, source of noise, and the capacitive, or electric field, source of noise.

Figure 3:
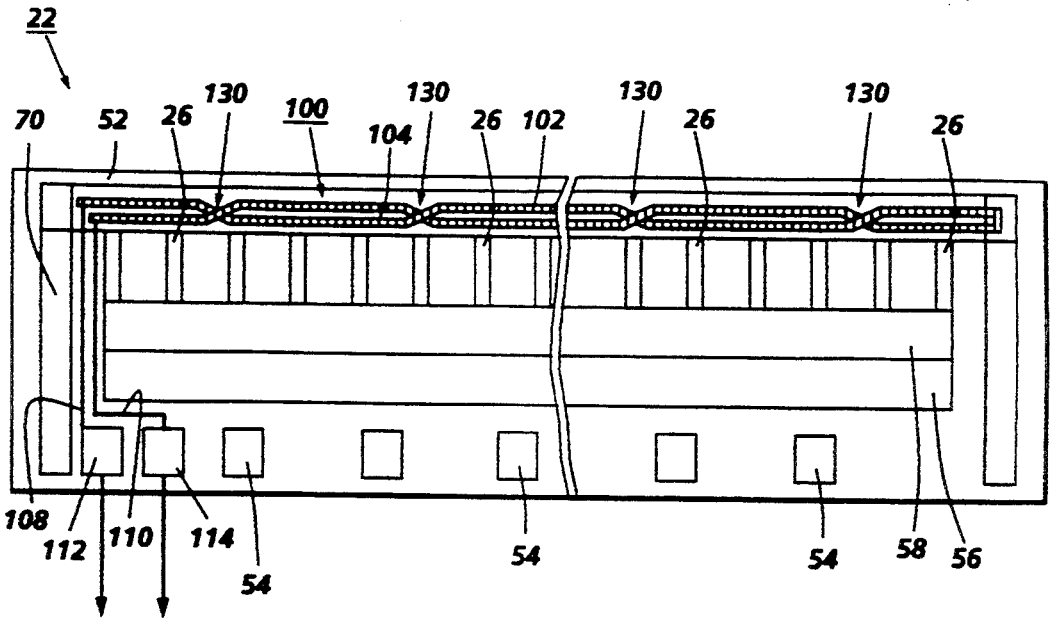
FIG. 3 is a plan view showing a substrate associated with an ink-jet printhead in isolation, showing an alternate embodiment of the present invention.

FIG. 3 is a plan view of a thermal ink-jet printhead chip showing a variation of the present invention, wherein the thermistor 100, in addition to having main lengths 102 and 104, have a number of "cross-overs" shown as 130, which are defined as locations in which the two main lengths cross to have an opposite configuration relative to the heating elements 26 for a given length between cross-overs. These cross-overs are readily obtained by placing a quantity of electrically insulating material (not shown) between the deposits forming either main length at their point of overlap. The purpose of providing these cross-overs 130 is to provide additional noise protection by reversing the polarity of the magnetic field pick up in each loop so that they will cancel. This arrangement also more nearly balances the parasitic capacity pick up.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A thermal ink-jet printhead, comprising:

a substrate having a plurality of heating elements defined in a linear array thereon; and a thermistor disposed on the substrate, including a conductor loop, the heating elements positioned exteriorly of the conductor loop on the substrate, the conductor loop defining first and second parallel elongated regions, each of the elongated regions being spaced along a main length thereof an equal distance from each of a plurality of heating elements in the linear array, and wherein the first elongated region is spaced between the second elongated region and equally from each of a plurality of heating elements in the linear array.

2. A printhead as in claim 1, further comprising a source for a reference voltage of a predetermined polarity across the thermistor, and an operational amplifier having inputs connected to the thermistor, the inputs being connected to signs opposite the polarity of the reference voltage across the thermistor.

3. A printhead as in claim 1, wherein the conductor loop comprises lightly doped polysilicon.

4. A thermal ink-jet printhead, comprising:

a substrate having a plurality of heating elements defined in a linear array thereon; and a thermistor disposed on the substrate, including a conductor loop, the heating elements positioned exteriorly of the conductor loop on the substrate, the conductor loop defining first and second substantially parallel elongated regions, each of the elongated region extending along the linear array of heating elements, the conductor loop further including a cross-over portion connecting a length of the first elongated region along the linear array of heating elements to a length of the second elongated region along the linear array of heating elements.

* * * * *